US008696250B2

(12) United States Patent
Ruel

(10) Patent No.: US 8,696,250 B2
(45) Date of Patent: Apr. 15, 2014

(54) BACKFILL SYSTEM FOR RETAINING WALL

(76) Inventor: Steve Ruel, Scotts Valley, CA (US)

( * ) Notice: Subject to any disclaimer, the term of this patent is extended or adjusted under 35 U.S.C. 154(b) by 266 days.

(21) Appl. No.: 12/718,923

(22) Filed: Mar. 5, 2010

(65) Prior Publication Data

US 2011/0103897 A1 May 5, 2011

Related U.S. Application Data

(60) Provisional application No. 61/256,917, filed on Oct. 30, 2009.

(51) Int. Cl.
*E02D 29/02* (2006.01)

(52) U.S. Cl.
USPC ..... 405/284; 405/262; 405/286

(58) Field of Classification Search
USPC ..... 405/284, 285, 286, 287, 262
See application file for complete search history.

(56) References Cited

U.S. PATENT DOCUMENTS

| | | | | |
|---|---|---|---|---|
| 3,747,353 | A | 7/1973 | Monahan | |
| 4,343,571 | A | 8/1982 | Price | |
| 4,470,728 | A | 9/1984 | Broadbent | |
| 4,494,892 | A * | 1/1985 | Wojciechowski | 404/6 |
| 4,756,645 | A | 7/1988 | Balzer | |
| 4,929,125 | A | 5/1990 | Hilfiker | |
| 4,960,349 | A | 10/1990 | Willibey | |
| 5,533,839 | A | 7/1996 | Shimada | |
| 5,549,418 | A | 8/1996 | Devine | |
| 6,086,288 | A | 7/2000 | Ruel et al. | |
| 6,238,144 | B1 | 5/2001 | Babcock | |
| 6,685,400 | B1 | 2/2004 | Ruel et al. | |
| 6,793,436 | B1 | 9/2004 | Ruel et al. | |
| 6,860,681 | B2 | 3/2005 | Ruel | |
| 6,908,263 | B1 | 6/2005 | Ruel et al. | |
| 6,939,087 | B2 | 9/2005 | Ruel | |
| 7,125,202 | B2 | 10/2006 | Morizot et al. | |
| 7,503,719 | B1 | 3/2009 | Ruel et al. | |
| 7,857,540 | B2 | 12/2010 | Ruel et al. | |
| 2003/0185634 | A1 | 10/2003 | Babcock | |

FOREIGN PATENT DOCUMENTS

| | | |
|---|---|---|
| JP | 02128017 | 5/1990 |
| JP | 03051426 | 8/1998 |

* cited by examiner

*Primary Examiner* — Benjamin Fiorello
(74) *Attorney, Agent, or Firm* — Michael R. Schacht; Schacht Law Office, Inc.

(57) ABSTRACT

A retaining wall system comprising an earth structure defining an earth surface, a wall system arranged on the earth surface, and a backfill structure arranged on the earth surface behind the wall system. The backfill structure comprises a base portion, a plurality of backfill members, and a cap portion. The base portion comprises at least one layer of loose backfill material. The plurality of backfill members are arranged in at least one course on top of the base portion. The cap portion comprises at least one layer of loose backfill material.

20 Claims, 2 Drawing Sheets

BACKFILL SYSTEM FOR RETAINING WALL

RELATED APPLICATIONS

This application, U.S. patent application Ser. No. 12/718,923 filed Mar. 5, 2010, claims benefit of U.S. Provisional Patent Application Ser. No. 61/256,917 filed Oct. 30, 2009.

The subject matter of the foregoing related applications is incorporated herein by reference.

TECHNICAL FIELD

The present invention relates to retaining walls and, more particularly, to systems for filling the volume behind a retaining wall with load bearing backfill.

BACKGROUND

Many construction activities require that backfill be arranged adjacent to a wall structure. As one primary example, retaining walls are often constructed to provide a substantially vertical surface that is typically not stable in nature. In constructing retaining walls, materials are arranged to fill the volume behind the wall structure.

The need exists for quick and cost effective methods of filling the volume behind a wall structure such as a retaining wall.

SUMMARY

A retaining wall system comprising an earth structure defining an earth surface, a wall system arranged on the earth surface, and a backfill structure arranged on the earth surface behind the wall system. The backfill structure comprises a base portion, a plurality of backfill members, and a cap portion. The base portion comprises at least one layer of loose backfill material that has been compacted. The plurality of backfill members are arranged in at least one course on top of the base portion. The cap portion comprises at least one layer of compacted, loose backfill material.

The present invention may also be embodied as a method of forming a retaining wall system comprising the following steps. An earth structure defining an earth surface is formed. A wall system is arranged on the earth surface. A base portion comprising at least one layer of loose backfill material is formed on the earth surface. The at least one layer of loose backfill is typically compacted. A plurality of backfill members are arranged in at least one course on top of the base portion. A cap portion comprising at is least one layer of compacted loose backfill material is formed on the top of the backfill members.

The present invention may also be embodied as retaining wall system comprising an earth structure defining an earth surface, a wall system arranged on the earth surface, a backfill structure, and at least one anchor structure. The backfill structure is arranged on the earth surface behind the wall system. The backfill structure comprises a base portion comprising at least one layer of compacted loose backfill material, a plurality of foam backfill members arranged in a plurality of courses each comprising a plurality of backfill members, a backfill pad arranged on top of the plurality of backfill members, and a cap portion comprising at least one layer of compacted loose backfill material. The at least one anchor structure is arranged within the base portion and connected to the wall system.

DETAILED DESCRIPTION

Figure 1:
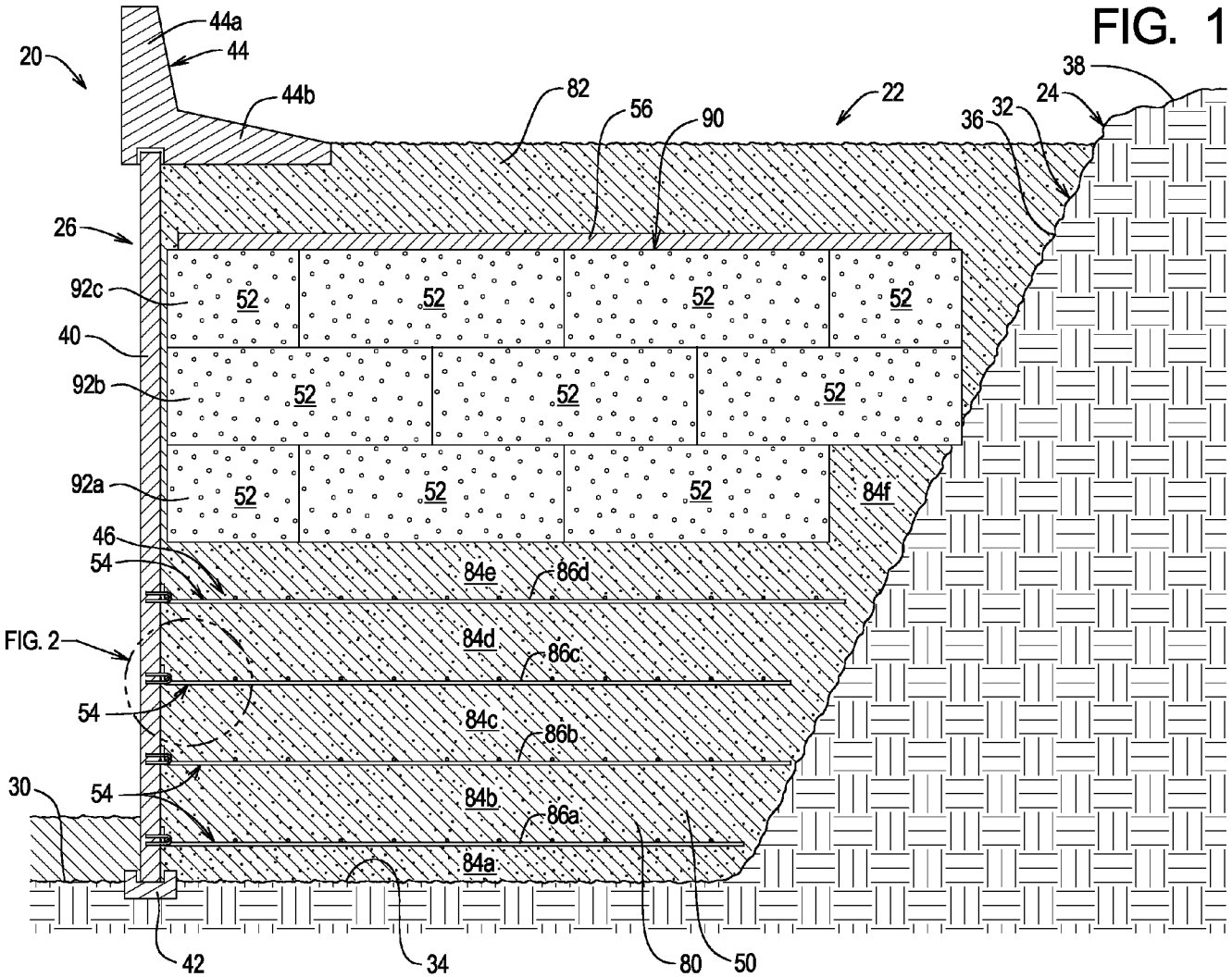
FIG. 1 is an elevation, sectional view of an example backfill system of the present invention.

Referring initially to FIG. 1 of the drawing, depicted therein is an example retaining wall system 20 employing a backfill system 22 constructed in accordance with, and embodying, the principles of the present invention. The example backfill system 22 system is arranged between an earth structure 24 and a wall assembly 26.

The example earth structure 24 illustrates one example situation in which use of a backfill system such as the example backfill system 22 may be appropriate. In particular, the earth structure 24 defines an earth surface 30 that in turn defines a surface contour 32. Following the surface contour as depicted in the section view of FIG. 1, it can be seen that the earth surface 30 defines a first portion 34, a second portion 36, and a third portion 38.

The backfill system 22, earth structure 24, and wall assembly 26 are illustrated in the two-dimensions in FIG. 1 for purposes of clarity. In this context, the example first and third portions 34 and 38 appear to be substantially horizontal, while the example second portion 36 appears to be angled with respect to horizontal. However, one of ordinary skill in the art will recognize that the actual earth surface 30 will be three-dimensional, and the various portions 34, 36, and 38 of the earth surface may undulate, and the first and third portions 34 and 38 may not be horizontal in all three dimensions. Accordingly, one of ordinary skill in the art will recognize that the earth structure 24 is represented and described in FIG. 1 by way of example only and that the principles of the present invention may be applied to earth structures having a variety of surface shapes and/or contours.

The example wall assembly 26 comprises a wall structure 40, an optional footer 42, an optional curb member 44, and an optional connecting system 46.

The wall structure 40 may be made of concrete, stone, timbers, metal, mesh, or the like. In this context, a wall structure used as part of the present invention may be a unitary structure and/or may be formed by a plurality of individual wall components. The unitary structure may, as examples, be a precast concrete slab or a cast-in-place concrete slab. The example wall structure 40 is a pre-cast concrete slab. The wall structure 40 may be made of reinforced and/or pre-stressed concrete. The example wall structure 40 is arranged in a substantially vertical orientation; alternatively, the wall structure 40 may be arranged in an orientation that is slightly canted towards the earth structure 24.

The example footer 42 of the example wall assembly 26 supports the wall structure 40 in a substantially vertical orientation. The example curb member 44 defines a short wall portion 44*a* and a curb portion 44 and is supported by the wall structure 40 and in part by the backfill system 22 such that the wall portion 44*a* defines a reverse wall that extends the height of the wall structure to a point above the backfill system 22. The example connecting system 46 ties at least a portion of the wall structure 40 into at least a portion of the backfill system 22. The curb member 44 and the connecting system 46 will be described in further detail below.

The example backfill system 22 comprises loose backfill 50 and backfill members 52 and, optionally, one or more anchor members 54 and a backfill pad 56. The loose backfill material 50 is typically compacted after being placed as shown in the drawings. The one or more anchor members 54 and backfill pad 56 are optionally used depending upon the nature of the particular installation of a backfill system of the present invention.

Figure 2:
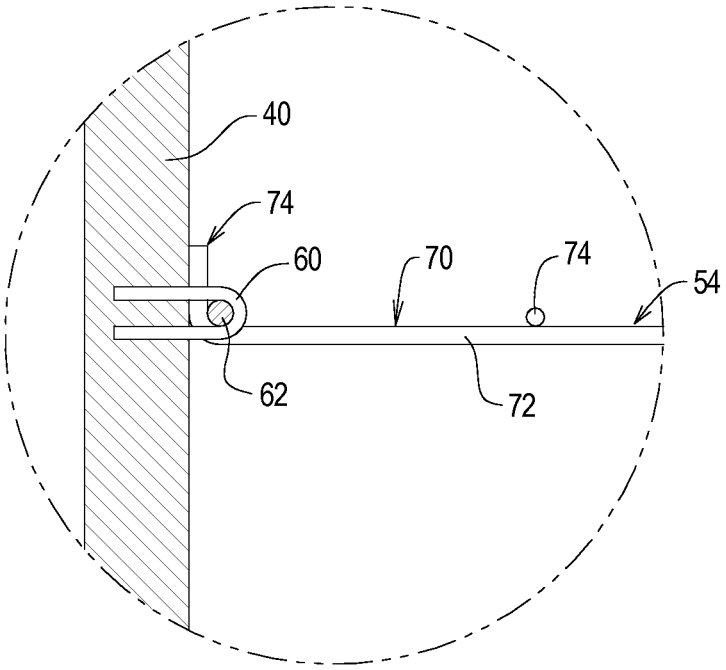
FIG. 2 is an elevation view of an example connecting assembly that may be used by the backfill system depicted in FIG. 1.

In the example backfill system 22, FIG. 2 illustrates that the one or more anchor members 54 are rigidly connected to the wall structure 40 by one or more connectors 60 and one or more connecting pins 62. The example connectors 60 are metal devices that are embedded within and extend from the wall structure 40; alternatively, the function of the connectors may be performed by voids such as passageways and/or pockets formed in the wall structure 40.

The example backfill system 22 comprises a plurality of anchor members 54. Anchor members used by any specific implementation of the principles of the present invention may be conventional; the example anchor members 54 each comprise a mesh structure 70 formed by a plurality of tension members 72 and a plurality of lateral members 74.

In the example connecting system 46, FIG. 2 further illustrates that one or more connecting portions 74 defined by the one or more anchor members 54 are aligned with one or more of the connectors 60. The example connecting portions 74 are formed by bending portions of the tension members 72. At least one connecting pin 62 is arranged relative to the connectors 60 and the connecting portions 74 to inhibit movement between the wall structure 40 and the one or more anchor members.

The connecting system 46 is not per se a part of the present invention. If a particular implementation requires the use of a connecting system to secure a wall structure to the backfill structure 22 of the present invention, any connecting system suitable for making such a connection may be used in place of the example connecting system 46.

Referring now back to FIG. 1 of the drawing, it can be seen that the loose backfill 50 is arranged to define a base portion 80 and a cap portion 82. In particular, when fabricating the wall structure 20, the footer 42 is first formed or arranged on the earth surface 30 at an appropriate location. The wall structure 40 may then be placed or formed on top of the footer 42. In the example backfill system 22, the unitary wall structure 40 is placed in its desired orientation on top of the footer 42. If the wall structure comprises individual components such as timbers or concrete blocks, the wall structure may be formed in stages as the loose backfill 50 is placed, as generally described below.

After or as the wall structure 40 is formed, the loose material 50 forming the base portion 80 is arranged on the first surface portion 34. The material forming the loose backfill 50 is typically compacted at various stages. If the connecting system 46 comprising the anchor members 54 is used, the loose material 50 forming the base portion 80 is placed on the first surface portion 34 in layers 84, and the anchor members 54 are arranged at appropriate levels on top of the layers 84 of base fill material 80 as defined by the locations of any connectors defined by the wall structure 40. Before each layer 84 of anchor members 54 is covered by the fill material forming the loose material 50 forming the base portion 80, the connecting pin or pins 62 are arranged to fix each anchor member 54 to the wall structure 40.

The nature of a particular installation will determine whether a connecting system 46 is used and, if so, how many anchor members 54 are used and the dimensions and the vertical and horizontal spacing between the anchor members 54. In the example system 20, the number of anchor members 54, and especially the number of vertically spaced layers 86 of anchor members 54, determined that the backfill system 22 comprises at least five layers 84*a*, 84*b*, 84*c*, 84*d*, and 84*e* of the loose material 50 forming the base portion 80 and four layers 86*a*, 86*b*, 86*c*, and 86*d* of the anchor members 54, as shown in FIG. 1. Each fill layer 84 is compacted as it is placed as described in further detail below.

Accordingly, the first layer 84*a* of base fill material 80 is placed on the first surface portion 34, and the first layer 86*a* of anchor members 54 is arranged on the first fill layer 84*a* and connected to the wall structure 40. Then, the second fill layer 84*b* is placed on the first fill layer 84*a* and first anchor layer 86*a*, and the second layer 86*b* of anchor members 54 is arranged on the second fill layer 84*b* and connected to the wall structure 40. The third fill layer 84*c* is next placed on the second fill layer 84*b* and second anchor layer 86*b*, and the third layer 86*c* of anchor members 54 is placed on the third fill layer 84*c* and connected to the wall structure 40. The fourth fill layer 84*d* is next placed on the third fill layer 84*c* and third anchor layer 86*c*, and the fourth layer 86*d* of anchor members 54 is placed on the fourth fill layer 84*d* and connected to the wall structure 40. The fifth fill layer 84*e* is then placed on the fourth fill layer 84*d* and fourth anchor layer 86*d*. The fifth fill layer 84*e* may then be graded in preparation for the installation of the backfill members 52.

The backfill members 52 are arranged in a stack 90 comprising a plurality of courses 92. The number and shape of the courses 92 depends on the dimensions and characteristics of the members 52 and the details of the particular retaining wall system 20. In the example system 20, three courses 92*a*, 92*b*, and 92*c* of the backfill members 52 are provided. These courses 92*a*, 92*b*, and 92*c* are staggered such that junctures between backfill members 52 in a given course are offset from the junctures between backfill members in the courses above and below that given course.

The material forming the backfill members 52 is selected to satisfy the structural needs of the backfill system 22 as generally discussed herein. Additionally, the material should be selected such that the structural characteristics of the backfill members 52 is maintained when subjected to environmental factors such as corrosion, water, insects, and the like. Finally, for a given set of minimum required structural characteristics, the material forming the backfill members 52 should be as light as possible to reduce the overall wall settlement, facilitate shipping and installation and as inexpensive as possible to reduce the overall costs of the backfill system 22.

The example backfill members 52 used by the example backfill system 22 are formed of materials such as polystyrene and lightweight cellular concrete. To reduce weight, the backfill members 52 are typically foam materials, and closed cell foam is preferable. In addition, the use of recycled and/or recyclable materials as the backfill members 52 and/or to form the backfill members 52 is preferable.

While the example backfill members 52 are shown as rectangular blocks, and this shape is convenient for the purpose of stacking the backfill members 52, other shapes can be used. Certain shapes, when stacked, may leave voids between adjacent members in the same course or between adjacent members in courses above and/or below. In this case, loose material can be arranged to fill these voids. Again, the loose material can be compacted to facilitate filling of the voids.

In the example backfill system 22, the second surface portion 36 is angled away from the wall structure 40, so the second and third courses 92*b* and 92*c* of backfill members 52 extend farther away from the wall structure 40 than the first course 92*a*. In this case, to support the backfill members 52 of the second and third courses 92*b* and 92*c* distal from the wall structure, an additional partial layer 84*f* of loose backfill 50 is arranged behind the first course 92*a* and below the second and third courses 92*b* and 92*c*. Again, each layer of loose backfill material 50 is typically compacted as placed.

The optional backfill pad 56 is formed or placed on top of the uppermost course 92*c* of backfill members 52. If used, the backfill pad 56 extends over substantially the entire upper course 92*c* of backfill members and distributes loads throughout the entire stack 90 of backfill members 52. As will be described in further detail below, the use of the backfill pad 56 can increase the load bearing capacity of the backfill system 22. Additionally, although only one backfill pad 56 is shown in FIG. 1, a plurality of such pads may be provided depending on the size and nature of the retaining wall system 20 and backfill system 22 forming a part thereof.

The backfill pad 56 can be made of any material capable of distributing point or narrowly directed loads up to an expected magnitude at any point on the backfill pad 56 throughout at least a larger portion of the upper course 92*c* of the stack 90 without failing. The example backfill pad 56 is a pre-cast or cast-in-place concrete pad. The backfill pad 56 may be made of reinforced and/or pre-stressed concrete.

After the stack 90 is formed and, if used, the backfill pad 56 is formed or placed on the top course 92*c*, the cap portion 82 of the loose material 50 is next placed on the top course 92*c* and/or backfill pad 56. In the example backfill system 22, the cap portion 82 covers the entire backfill pad 56 and any portion of the stack 90 not covered by the backfill pad. The cap portion 82 further extends in front of and behind the stack 90 as necessary to fill any volume behind the wall assembly 26 and the earth structure 24 not already filled by the base portion 80 and/or the stack 90. The entire cap portion 92 is then optionally compacted.

As described above, the curb member 44 is supported in part by the wall structure 40 and in part by the backfill system 22. In particular, the example curb member 44 is arranged such that at least the curb portion 44*b* of the curb member is supported by a portion of the compacted cap portion 82 adjacent to the wall structure 40.

The cap portion 82 simply be compacted and left as compacted loose material 50 as shown in FIG. 1. However, in addition or instead, other structures such as paving, foundations, buildings, and the like may be formed on top of the cap portion 82 within the load bearing limits of the backfill system 22 and the retaining wall system 20.

From the foregoing, it should be apparent that the present invention may be embodied in many different combinations and sub-combinations of the elements and steps described above. The scope of the present invention should thus be determined by the claims to be appended hereto and not the foregoing detailed description.

What is claimed is:

1. A retaining wall system comprising:
an earth structure defining an earth surface;
a wall system arranged on the earth surface; and
a backfill system arranged on the earth surface behind the wall system, where the backfill system comprises
a base portion comprising a plurality of layers of loose backfill material,
at least one anchor structure arranged between each of the plurality of layers of the base portion, where each anchor structure is connected to the wall system,
a plurality of backfill members arranged in a plurality of courses in a stack on top of the base portion, where at least one of the courses is an upper course comprising a plurality of backfill members,
a backfill pad arranged on top of the backfill members, where the backfill pad is formed of a rigid structure that extends over and is in contact with at least a portion of each of the backfill members forming an upper course of the stack of backfill members, and
a cap portion comprising at least one layer of loose backfill material arranged on top of the backfill pad.

2. A retaining wall system as recited in claim 1, in which the backfill pad distributes narrowly directed loads up to an expected magnitude at any point on the backfill pad throughout at least a larger portion of the upper course of the stack of backfill members without failing.

3. A retaining wall system as recited in claim 1, in which the backfill pad is comprised of at least one of pre-cast concrete and cast-in-place concrete.

4. A retaining wall system as recited in claim 1, in which the wall system comprises:
a wall structure; and
a curb member supported at least in part by the wall structure and at least in part by the cap portion.

5. A retaining wall system as recited in claim 1, in which:
each course comprises a plurality of backfill members; and
the backfill pad is arranged above at least a plurality of the backfill members in each of the courses.

6. A retaining wall system as recited in claim 1, in which the plurality of anchor members are arranged in a plurality of anchor courses, where one anchor course is formed between each adjacent layer of loose backfill material forming the base portion.

7. A retaining wall system as recited in claim 1, in which the backfill members are made of foam.

8. A retaining wall system as recited in claim 1, in which the backfill members are made of closed cell foam.

9. A retaining wall system as recited in claim 1, in which the backfill members are made of recycled material.

10. A method of forming a retaining wall system comprising the steps of:
forming an earth structure defining an earth surface;
arranging a wall system on the earth surface;
forming a base portion comprising a plurality of layers of loose backfill material on the earth surface;
arranging at least one anchor structure within the base portion;
connecting the at least one anchor structure to the wall system;
arranging a plurality of backfill members in a plurality of courses in a stack on top of the base portion, where at least one of the courses in the stack is an upper course comprising a plurality of backfill members;
arranging a rigid backfill pad structure on top of the stack of backfill members such that the backfill pad extends over and is in contact with at least a portion of each of the backfill members forming the upper course of the stack of backfill members; and
forming a cap portion comprising at least one layer of loose backfill material on top of the backfill pad.

11. A method of forming retaining wall system as recited in claim 10, in which the step of arranging the backfill pad on top of the stack of backfill members comprises the step of forming the backfill pad such that the backfill pad distributes narrowly directed loads up to an expected magnitude at any point on the backfill pad throughout at least a larger portion of the upper course of the stack of backfill members without failing.

12. A method of forming a retaining wall system as recited in claim 10, in which the step of arranging the backfill pad on top of the stack of backfill members comprises the step of forming the backfill pad of at least one of pre-cast concrete and cast-in-place concrete.

13. A method of forming a retaining wall system as recited in claim 10, in which the step of forming the wall system comprises the steps of:

forming a wall structure; and supporting a curb member at least in part by the wall structure and at least in part by the cap portion.

14. A method of forming a retaining wall system as recited in claim 10, in which step of arranging the plurality of backfill members comprises the steps of:

forming each course of a plurality of backfill members; and arranging the backfill pad above at least a plurality of the backfill members in each of the courses.

15. A method of forming a retaining wall system as recited in claim 10, in which step of arranging the plurality of anchor members comprises the step of arranging the plurality of anchor members in a plurality of anchor courses, where one anchor course is formed between each adjacent layer of loose backfill material forming the base portion.

16. A method of forming a retaining wall system as recited in claim 10, in which the backfill members are made of foam.

17. A method of forming a retaining wall system as recited in claim 10, in which the backfill members are made of closed cell foam.

18. A method of forming a retaining wall system as recited in claim 10, in which the backfill members are made of recycled material.

19. A retaining wall system comprising:

an earth structure defining an earth surface;

a wall system arranged on the earth surface;

a backfill system arranged on the earth surface behind the wall system, where the backfill system comprises a base portion comprising a plurality of layers of loose backfill material, at least one anchor structure arranged between each of the plurality of layers of the base portion, where each anchor structure is connected to the wall system, a plurality of foam backfill members arranged in a plurality of courses each comprising a plurality of backfill members, where at least one of the courses is an upper course comprising a plurality of backfill members, a backfill pad on top of the plurality of backfill members, where the backfill pad is formed of a rigid structure that extends over at and is in contact with least a portion of each of the backfill members forming the upper course of the stack of backfill members, and a cap portion comprising at least one layer of loose backfill material on top of the backfill pad.

20. A retaining wall system as recited in claim 19, in which the backfill members are made of at least one material selected from the group consisting of closed cell foam and recycled material.

* * * * *